US009611612B2

(12) United States Patent
Jung et al.

(10) Patent No.: US 9,611,612 B2
(45) Date of Patent: Apr. 4, 2017

(54) DEVICE AND METHOD FOR REDUCING NOISE

(71) Applicant: IHC Holland IE B.V., Sliedrecht (NL)

(72) Inventors: Boudewijn Casper Jung, Bergen op Zoom (NL); Jan Albert Westerbeek, Spijkenisse (NL)

(73) Assignee: IHC Holland IE B.V., Sliedrecht (NL)

( * ) Notice: Subject to any disclaimer, the term of this patent is extended or adjusted under 35 U.S.C. 154(b) by 219 days.

(21) Appl. No.: 14/321,742

(22) Filed: Jul. 1, 2014

(65) Prior Publication Data

US 2015/0096830 A1 Apr. 9, 2015

Related U.S. Application Data

(63) Continuation of application No. 13/379,921, filed as application No. PCT/NL2010/050384 on Jun. 22, 2010, now Pat. No. 8,820,472.

(30) Foreign Application Priority Data

Jun. 23, 2009 (NL) ..... 2003073

(51) Int. Cl.
*G10K 11/00* (2006.01)
*G10K 11/16* (2006.01)
(Continued)

(52) U.S. Cl.
CPC ..... *E02D 13/005* (2013.01); *E02B 17/00* (2013.01); *E02B 17/0008* (2013.01);
(Continued)

(58) Field of Classification Search
CPC ..... E02D 13/005; E02D 13/00; E02D 7/02; E02D 27/52; E02B 17/00; E02B 17/0008;
(Continued)

(56) References Cited

U.S. PATENT DOCUMENTS 2,735,504 A * 2/1956 Moyer ..... F01N 1/06 181/260
3,312,295 A * 4/1967 Bodine, Jr. ..... E02D 7/18 175/19
(Continued)

FOREIGN PATENT DOCUMENTS

DE 2237133 A1 * 2/1974 ..... E02D 13/00
DE 102006008095 8/2007
(Continued)

OTHER PUBLICATIONS

International Search Report for PCT/NL2010/050384 dated Jun. 27, 2011.

*Primary Examiner* — David Warren
*Assistant Examiner* — Christina Schreiber
(74) *Attorney, Agent, or Firm* — NLO; Catherine A. Shultz; Minervo Rivero

(57) ABSTRACT

A device for and methods of reducing sound vibrations in a liquid resulting from a sound source arranged below the liquid level of a body of water are disclosed. The device includes an elongate tube which can be arranged over the sound source, the tube comprising an outer wall and inner wall with an intermediate space between the inner and outer wall.

20 Claims, 3 Drawing Sheets

(51) Int. Cl.

| | |
|---|---|
| ***E02B 17/00*** | (2006.01) |
| ***E02D 13/00*** | (2006.01) |
| ***E02D 7/02*** | (2006.01) |
| ***E02D 27/52*** | (2006.01) |
| ***E02D 7/14*** | (2006.01) |
| ***E02D 17/00*** | (2006.01) |

(52) U.S. Cl.
CPC ..... *E02B 17/0013* (2013.01); *E02D 7/02* (2013.01); *E02D 7/14* (2013.01); *E02D 13/00* (2013.01); *E02D 17/00* (2013.01); *E02D 27/52* (2013.01); *G10K 11/004* (2013.01); *G10K 11/16* (2013.01)

(58) Field of Classification Search
CPC ..... E02B 17/0013; B25D 9/00; G10K 11/004; G10K 11/16
USPC ..... 181/205, 198, 196; 405/225, 232
See application file for complete search history.

(56) References Cited

U.S. PATENT DOCUMENTS 3,459,259 A * 8/1969 Matthews ..... E21B 7/128 166/355
3,463,252 A * 8/1969 Garrett ..... E21B 17/07 175/27
3,583,499 A * 6/1971 Cordes ..... B25D 9/12 173/131
3,601,999 A * 8/1971 Olsen ..... E21B 33/143 405/225
3,839,872 A * 10/1974 Loire ..... E02D 5/40 405/225
4,077,224 A * 3/1978 Coone ..... E02D 5/62 405/225
4,319,647 A * 3/1982 Browning ..... B28D 1/221 175/14
4,552,486 A * 11/1985 Knox ..... E02B 17/0008 405/225
4,569,402 A * 2/1986 Landaeus ..... E02D 7/08 173/126
4,637,758 A * 1/1987 Tamaki ..... E02D 7/20 405/232
4,826,356 A * 5/1989 Brisco ..... A01G 25/162 137/627
5,071,288 A * 12/1991 Brisco ..... E02B 17/0008 137/70
6,048,137 A * 4/2000 Beck, III ..... E02D 19/18 405/233
7,104,329 B2 * 9/2006 Kleinhans ..... E21B 19/002 166/354
7,556,453 B2 * 7/2009 Collina ..... E02D 5/28 405/229
7,717,642 B2 * 5/2010 Patten ..... E01D 19/02 114/264
8,011,446 B2 * 9/2011 Wylie ..... C09K 8/12 175/22
8,500,369 B2 * 8/2013 Mohr ..... E02D 7/02 181/198
8,820,472 B2 * 9/2014 Jung ..... E02D 7/14 181/196
2004/0031614 A1 * 2/2004 Kleinhans ..... E21B 19/002 166/355
2006/0188343 A1 * 8/2006 Bell ..... E02D 7/30 405/232
2009/0129871 A1 * 5/2009 Mohr ..... E02D 13/00 405/232
2012/0046866 A1 * 2/2012 Meyer ..... E21B 28/00 702/6
2012/0241039 A1 * 9/2012 Jung ..... E02D 7/14 138/155
2014/0154015 A1 * 6/2014 Jung ..... E02D 13/00 405/184.1
2016/0010306 A1 * 1/2016 Reinhall ..... E02D 13/005 405/228

FOREIGN PATENT DOCUMENTS

| | | |
|---|---|---|
| EP | 0301114 | 2/1989 |
| JP | 60159218 | 8/1985 |
| JP | 530233 | 4/1993 |
| WO | 2013056713 A1 | 4/2013 |

* cited by examiner

DEVICE AND METHOD FOR REDUCING NOISE

BACKGROUND

The present invention relates to a device, assembly and method for the passive reduction of sound vibrations in a liquid, in particular water, resulting from a sound source arranged below the liquid level.

During underwater operations, relatively high noise levels may be generated which can be harmful to animals or humans situated nearby. If, for example, pile-driving has to be carried out under water, in which case a pile element, such as for example a pile, is driven into the ground by means of a pile-driving device above water, this can generate very high noise levels under water. As the noise is generated under water, the sound waves will be audible at a much greater distance from the sound source than if the sound source were above water. In practice, it has been found that when pile-driving activities are carried out, no other underwater activities can be carried out in the vicinity, that is to say within a radius of one kilometre or more, which require divers working under water. Sound sources other than a pile, for example a sonar or an explosive, such as a sea mine, or a cavitating screw of a vessel can also produce so much noise that this can result in damage to animals and humans in the vicinity of the sound source.

DE 10 2006 008095 A1 in the name of MENCK GMBH discloses a pile surrounded by a sleeve. The sleeve has a sandwich-type structure and comprises an inner wall and an outer wall. Sound-insulating material is provided between the inner wall and the outer wall and connects the inner wall and the outer wall to one another along the entire periphery, but under certain circumstances and in particular under water, this may cause undesirable transmission of sound vibrations.

JP 60 159218 A discloses a ramming hammer equipped with a sound insulator. Said sound insulator is a resilient bellows which can be arranged around a sound source. The sound insulator is filled with water. This sound insulator seems to be particularly suited for use on land and is not suitable to form and maintain an intermediate space under water.

DE 25 38 642 A1 does not relate to a sound insulator for a pile. The subject matter of this publication is a ramming hammer and in particular the operation thereof under water.

DE 22 37 133 A1 discloses a telescopic insulating screen. This insulating screen is unsuitable for underwater use since this involves large lateral forces which are due to for example tidal flows.

JP 05 030233 appears to disclose a sleeve, but this sleeve is not suitable to be used for maintaining a gas-filled space under water.

JP 04 070416 discloses a sound-insulating device for use on land which is unsuitable for use under water.

SUMMARY

A device for the passive reduction of the sound vibrations in a liquid resulting from a sound source arranged below the liquid level of a body of water includes an elongate tube which can be arranged over the sound source. The tube includes an outer wall, an inner wall and an uninterrupted and sealed intermediate space in between the outer wall and the inner wall and along the entire length of the tube and extending in the longitudinal direction of the tube. The contents of the intermediate space between the inner and outer wall are formed completely by gaseous matter for reducing vibration transmission via the intermediate space to the body of water.

A method for the passive reduction of the sound vibrations in a liquid resulting from a sound source arranged under the liquid level of a body of water includes positioning a tube in the body of water around the sound source; and anchoring the tube at the bottom end and/or the top end. The tube has an uninterrupted and sealed intermediate space in between an outer wall and an inner wall.

DETAILED DESCRIPTION

Figure 1:
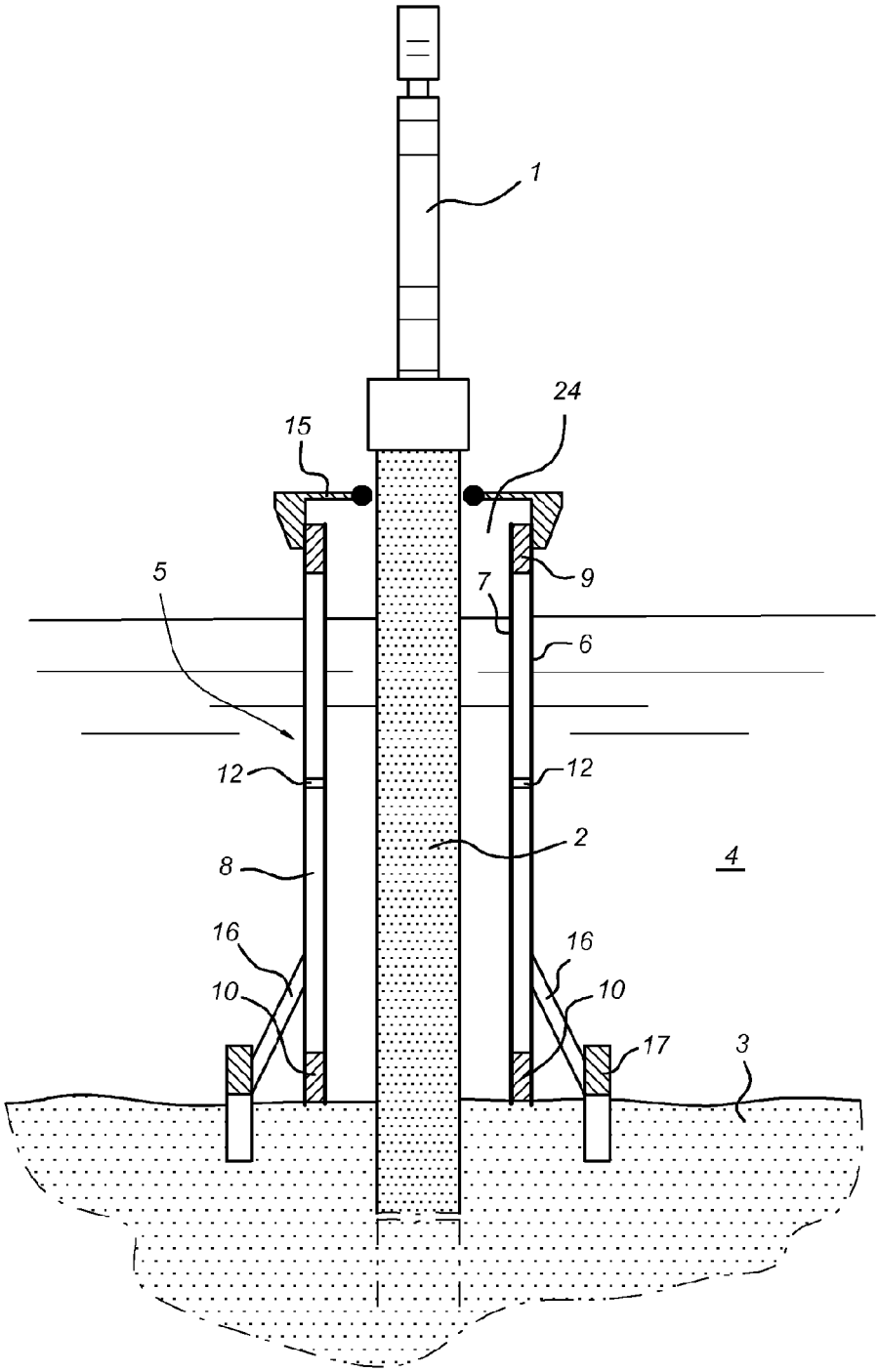
FIG. 1 shows a diagrammatic longitudinal section through a first embodiment of the present invention.

It is an object of the present invention to provide a device and a method for reducing the sound vibrations generated by a sound source under water.

According to a first aspect of the present invention, this object is achieved by means of a device for the passive reduction of the sound vibrations in a liquid resulting from a sound source which is arranged below the liquid level of a body of water, the device comprising an elongate tube which can be arranged over the sound source, the tube comprising an outer wall and an inner wall and an intermediate space in between, extending in the longitudinal direction of the tube, wherein the contents of the intermediate space between the inner and outer wall are formed completely by gaseous matter for reducing vibration transmission via the intermediate space to the body of water. The intermediate space preferably extends along the entire length of the tube. The intermediate space preferably extends along the entire periphery of the tube.

The intermediate space being substantially filled with a gaseous matter results in a reduction in the vibration transmission from the central interior space of the tube, via the intermediate space(s) between the inner and outer wall(s) of the tube, to the environment. The noise pollution of the environment can thus be significantly reduced.

According to a further aspect of the present invention, this object is achieved by a device for the passive reduction of the sound vibrations in water caused by an underwater sound source, in which the device comprises an elongate tube which can be arranged over the sound source, the tube comprising an outer wall and an inner wall, in which the contents of the intermediate space between the inner and outer wall are substantially formed by gaseous matter.

The pressure of the gaseous matter in the intermediate space(s) of the tube can be equal to or even higher than the local air pressure since a reduction in noise transmission can also be achieved at such pressures. However, in other embodiments of the invention, the pressure in the intermediate space(s) is reduced with respect to the ambient pressure. In this case, the pressure can be as low as 0.5 bar or lower, for example 0.1 bar or even lower still. As will be explained below, the latter is referred to as a "vacuum" in the intermediate space(s).

Due to the reduced pressure, the propagation of the sound vibrations can be influenced. When the intermediate space at reduced pressure is now arranged so as to completely surround the sound source in the shape of a tube, in particular a cylindrical tube having a concentric inner and outer wall, the noise is partially attenuated by the various media and only a small part of the noise will be allowed through. As a result thereof, the noise levels in the vicinity of the sound source (but obviously outside the interior space defined by the tube) are significantly reduced.

The outer wall and inner wall of the tube can be provided one after the other in the body of water, for example by first anchoring the inner wall into the bottom and then anchoring the outer wall which is arranged around it into the bottom. However, it is also possible to place the tube as a whole, that is to say with the inner and outer wall already assembled to form a single part, on the bottom. The advantage thereof is that the tube can be prefabricated on land and that the intermediate space can be closed off in an airtight manner at the top and at the bottom in a relatively simple manner by sealing means.

In a specific embodiment, the sealing means are designed to seal the space with respect to the environment in order to be able to maintain the pressure in the intermediate space and/or to prevent material from outside the tube entering the intermediate space(s), for example, bottom material at the underside of the tube. The sealing means can also or alternatively be flexible in order to prevent too many sound vibrations from still being conducted through the device. The sealing means can be elastic, and can be arranged near the two ends of the intermediate space in order to be able to effectively seal off the intermediate space and/or to have a vibration-insulating effect.

In order to reduce the transmission of noise via the tube, the pressure in the intermediate space can be reduced with respect to the ambient pressure, for example, by making it smaller than 0.5 bar, preferably smaller than 0.1 bar. The reduced pressure, also referred to as the "vacuum" in the present document, may already be established, for example, during production if a prefabricated tube having an inner wall and an outer wall is used, but can also be established when the tube is being installed on the bottom. In the latter case, suction means, such as one or more vacuum pumps, may be connected to the intermediate space and activated in order to reduce the pressure in the intermediate space.

In a further embodiment, the tube comprises one or more partition walls arranged between the outer and inner wall. As a result thereof, a number of intermediate spaces can be created, which can be situated next to one another viewed in the radial direction. In certain situations, such adjoining intermediate spaces make it possible to reduce the noise more efficiently.

In a further embodiment, means are provided for dispensing gas bubbles. The means for dispensing gas bubble can be designed to allow the gas bubbles to rise upward along an inner side of the inner wall of the tube. As a result thereof, a kind of bubble screen can be created in the interior space. The bubble screen makes it possible to reduce the transmission of noise further in certain situations.

According to a further embodiment, the at least one tube can be of the self-penetrating type in order to anchor one end of the tube in the ground below the body of water. A tube of such a type can anchor itself in the ground on its own, for example as a result of the bottom end being designed such that the tube digs itself into the ground, for example, due to its own weight. In addition thereto, or as an alternative thereof, the tube may be provided with adjustable suction anchors. Such anchors can attach themselves to the bottom by suction and thus result in a secure anchoring with respect to which the tube can be positioned.

According to embodiments of the invention, the tube is dimensioned such that it stands free from a sound source when it has been arranged over the sound source. In these embodiments, there can be no direct contact between the sound source and the tube, so that no or at least substantially no transfer of contact noise takes place. The total transmission of noise from the sound source to the environment can thus be reduced further.

According to another aspect of the invention, a device is provided for the passive reduction of the sound vibrations in a liquid resulting from a sound source which is arranged below the liquid level of a body of water, the device comprising an elongated tube which can be arranged over the sound source. A pump means for at least partially pumping out the central inner space delimited by the tube in order to reduce the transmission of noise from the sound source to the inside of the tube can also be provided.

This embodiment of the invention is based on forming an area without liquid between the sound source and the surroundings. The area without liquid transmits the noise from the sound source less readily to the surroundings. If the liquid in the tube at the location of the sound source is partially or completely removed by pumping the interior dry, the noise transmission from the sound source to the inside of the tube will be reduced and thus the noise transmission from the sound source to the environment around the tube will also be reduced. Herewith the noise pollution can be reduced.

More generally, the area without liquid can be formed by the abovementioned intermediate space(s) between the inner and outer wall (and any partition walls) and/or by the central interior space in the tube (if the liquid level thereof has been sufficiently reduced).

According to another aspect of the invention, a method is provided for the passive reduction of the sound vibrations in water emanating from an underwater sound source, the method comprising:

arranging a tube in the body of water, wherein the tube is positioned around the sound source;

anchoring the tube at the bottom end and/or the top end.

In this case, the tube is arranged over a sound source which is already present or the tube is positioned first and only then is the sound source, such as a pile element, brought into position in the tube.

The method may also comprise the at least partial pumping out of the interior space of the tube so that the sound source protrudes completely or partially above the water level in the tube. In addition or as an alternative, the method may comprise pumping water out of the intermediate space, if desired in combination with producing a reduced gas pressure, in particular air pressure, in the intermediate space. In all said embodiments, the transmission of noise from the sound source to the surroundings takes place at least partially via an area without liquid. This results in a reduction of the transmission of noise to the environment.

Further advantages, features and details will be explained by means of the following description of embodiments thereof.

FIG. 1 shows a pile-driving device 1 by means of which a pile element 2 can be driven into the bottom 3 of a body of water 4. An elongate tube 5 is provided around the pile element 2. The elongate tube 5 comprises an outer wall 6 and an inner wall 7. The outer and inner wall are arranged concentrically with respect to one another, with an intermediate space 8 being present between the outer and inner wall. In another embodiment, which is not illustrated, more tubes have been arranged inside one another, thus creating more intermediate spaces. This intermediate space 8 forms a pressure chamber in which a reduced pressure can be produced. To this end, the intermediate space 8 is sealed off at the top by a first insulator 9 and at the bottom by a second insulator 10. The insulators not only seal the intermediate space 8 in such a manner that no air can penetrate into the intermediate space 8, but are also designed to insulate against vibration in order to prevent sound waves incident on the inner wall 7 from being transmitted to the outer wall 6 via a more or less rigid connection. Rubber may for example be used as a suitable vibration-insulating material, and may if desired be inflatable. In certain embodiments, it is also possible to use various layers of different media.

In certain embodiments, separate suction means (not illustrated in the figure) are provided which are connected to the intermediate space and which are designed to reduce the pressure in the intermediate space to the desired degree by sucking out air.

In the illustrated embodiment, the tube is of a substantially cylindrical design. In other embodiments (not shown), the tube may of course have another shape, provided that an intermediate space is formed between the outer and inner wall which can reduce the transmission of noise or vibrations to the environment.

The tube 5 is preferably made from steel walls having the abovementioned vibration-insulating insulators 9, 10 provided in between and possibly, if the design requires it, a number of connections 12 between the outer and inner wall. Such a connection 12 does not necessarily extend around the entire periphery of the tube 5, so that one intermediate space 8 can advantageously be formed along the entire length of the tube 5. Obviously, these connections 12 also have to be designed to be as flexible as possible in order to keep the rigidity of the connection between the outer and inner walls small. However, the inner and/or outer tube can also be made from concrete or from a composite material. Likewise, a sandwich structure using composite materials, in which the core of the sandwich insulates against the transmission of vibrations, is an option.

The structure of the tube may be self-supporting, which means that no separate supporting structure has to be provided in order to keep the tube in its vertical position. If the tube is for example anchored at the bottom of a body of water, such as a lake, a river or the sea, an additional supporting structure for keeping the tube in position can in many cases be omitted. As an alternative or in addition, the tube can, in certain embodiments, be designed to be self-aligning, so that it will tend to remain standing in an upright position. Preferably, however, the tube is self-penetrating so that it anchors itself in the bottom without requiring additional equipment and/or operations.

FIG. 1 shows that spacers 15 are provided at the top of the tube. These spacers ensure that the sound source, for example the pile 2, remains centred in the tube. Due to the fact that the diameter of the sound source (e.g. the pile 1) can vary along its length, the spacers are adjustable so that they can allow for the narrowing and widening of the sound source and can keep the sound source centred, irrespective of its dimensions.

FIG. 1 furthermore shows that a number of (for example three) adjustable suction anchors 17 are provided on the bottom of the tube which are preferably distributed equally over the periphery of the tube. These anchors can anchor themselves to a greater or lesser degree in the bottom in a known manner. By anchoring the anchors at a greater or lesser depth in the bottom and/or by adjusting the connecting elements 16 between the tube 5 and the suction anchors 17, the tube can be fixed in a correct position with respect to the bottom.

The dimensions of the device vary, depending on the dimensions of the sound source.

If the sound source is formed by a pile or the like (with the pile having a characteristic diameter of 4-6 m or more), the diameter of the tube will in practice be 7 m or more, so that the distance between the sound source and the inner side of the tube is sufficiently large to prevent contact noise (that is to say transmission of noise by direct contact between the sound source and the tube).

Figure 2:
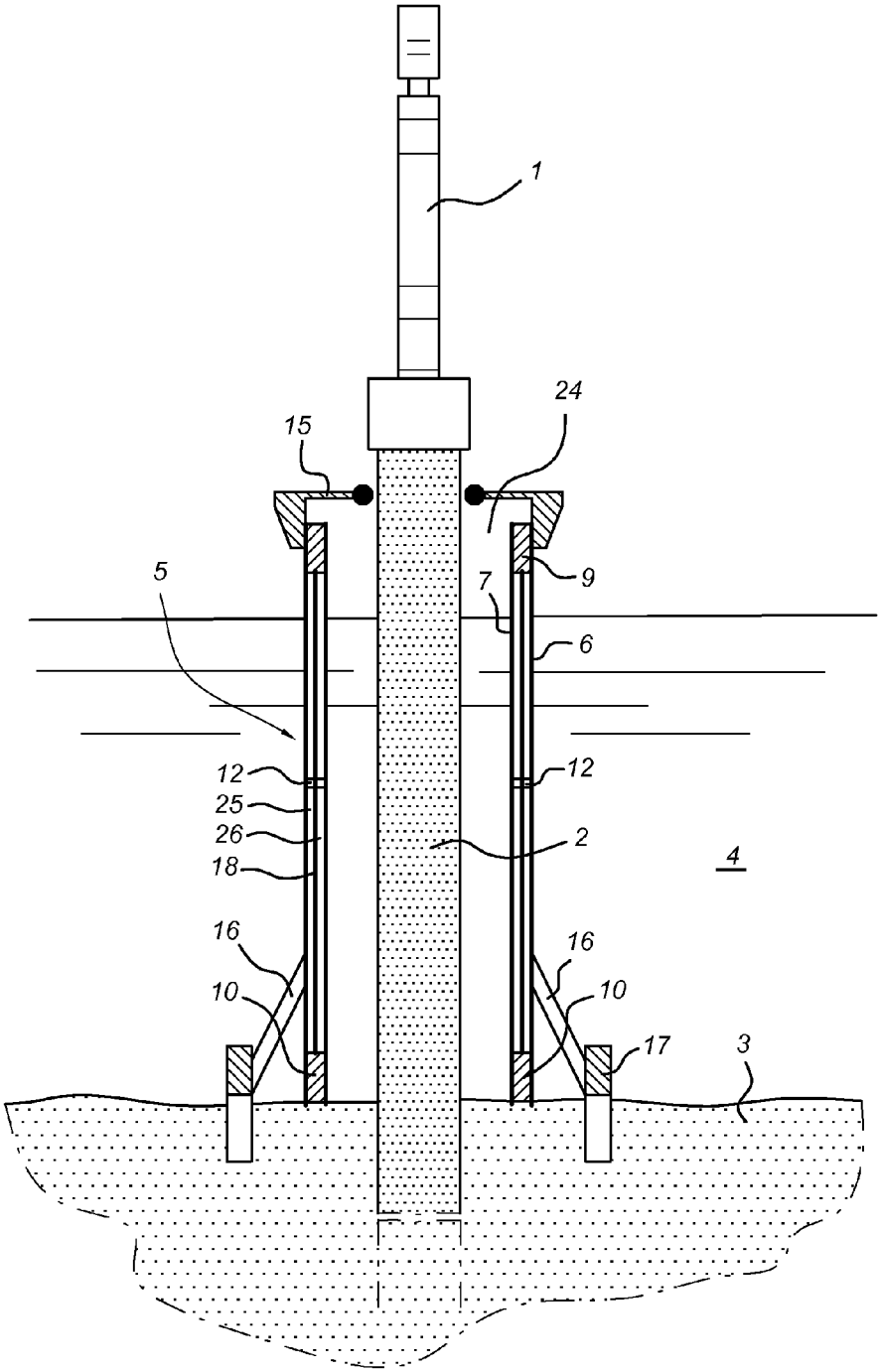
FIG. 2 shows a diagrammatic longitudinal section through a second embodiment of the present invention.

FIG. 2 shows another embodiment in which a partition wall 18 is arranged between the outer wall 6 and inner wall 7. In this way, two (or more) adjoining intermediate spaces 25 and 26 are created in order to achieve a significant noise reduction between the sound source and the surroundings.

Figure 3:
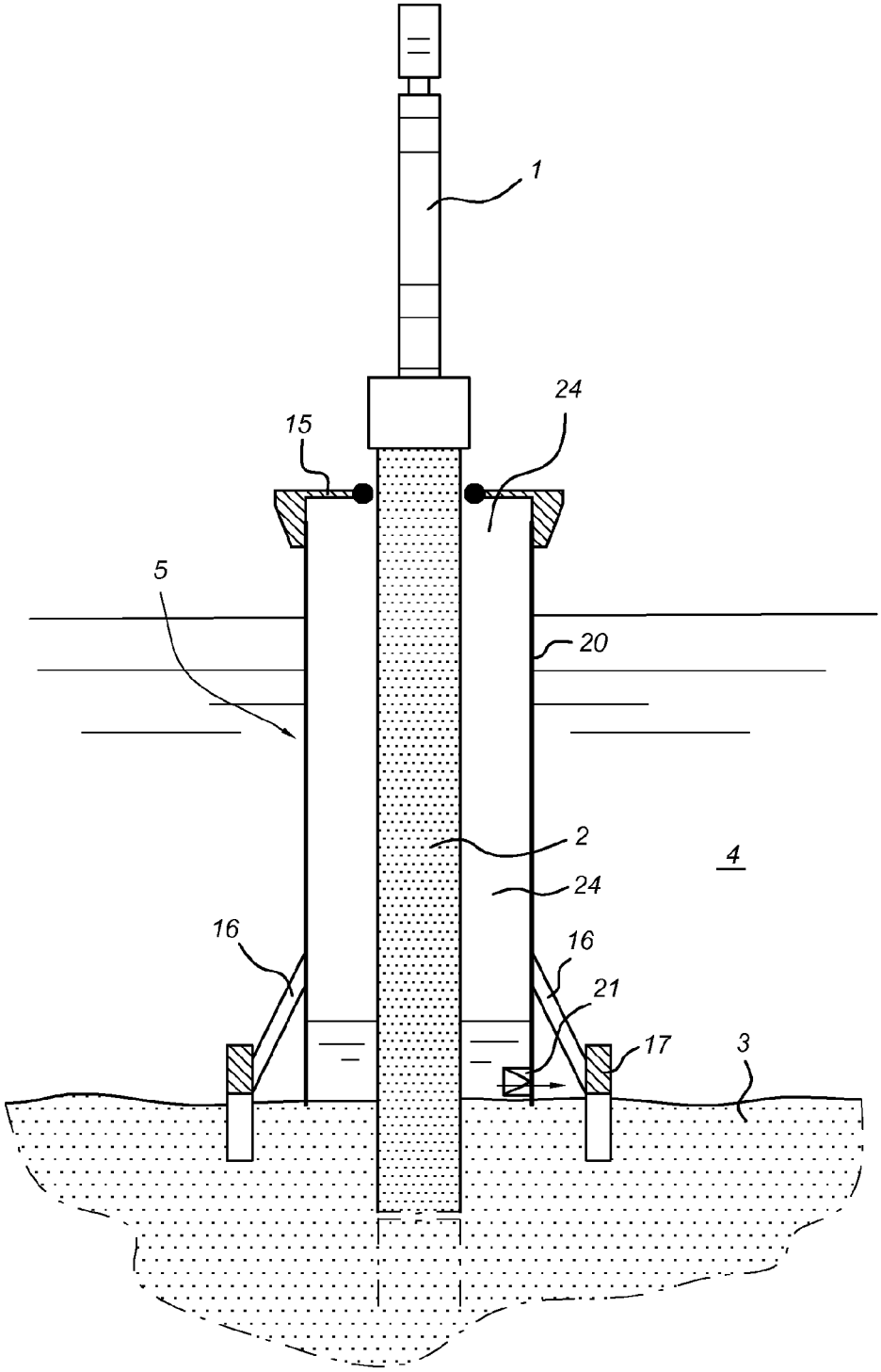
FIG. 3 shows a diagrammatic longitudinal section through a third embodiment of the present invention.

FIG. 3 shows the embodiment in which a single-walled tube 20 is used. In this embodiment, one or more pumps 21 are provided (which are only indicated diagrammatically in the figure) which can reduce the water level in the interior space 24. Along the distance over which the water level in the interior space 24 has sunk, less transmission of noise from the sound source to the environment outside the tube 2 occurs, so that the noise pollution for the surroundings is reduced. In another embodiment (not shown), the water level in the central interior space 24 in the tube is also reduced if the tube is designed as having several walls, as illustrated for example in FIG. 1 or 2, in order to achieve a further reduction in the transmission of noise.

The present invention is not limited to the embodiments thereof described above. Rather, the rights which are requested are determined by the following claims which allow for numerous modifications.

The invention claimed is:

1. A device for the passive reduction of the sound vibrations in a liquid resulting from a sound source arranged below the liquid level of a body of water, the device comprising an elongate tube which can be arranged over the sound source and, in use, extends to a level above the liquid level, the tube comprising an outer wall, an inner wall and an uninterrupted and sealed intermediate space in between the outer wall and the inner wall and along the entire length of the tube, extending in the longitudinal direction of the tube, with the contents of the intermediate space between the inner and outer wall being formed completely by gaseous matter for reducing vibration transmission via the intermediate space to the body of water.

2. The device according to claim 1, in which air is provided inside the intermediate space.

3. The device according to claim 1, in which the pressure in the intermediate space is lower than the ambient pressure of the air above the body of water.

4. The device according to claim 3, in which the pressure in the intermediate space is lower than 0.5 bar, preferably lower than 0.1 bar.

5. The device according to claim 4, in which the pressure in the intermediate space is lower than 0.01 bar.

6. The device according to claim 1, and further comprising sealing means for sealing the intermediate space with respect to the environment.

7. The device according to claim 6, in which the sealing means are provided near both ends of the double-walled tube.

8. The device according to claim 1, in which the tube is self-supporting.

9. The device according to claim 1, wherein the tube is self-aligning.

10. The device according to claim 1, and further comprising one or more partition walls arranged between the outer and inner wall to form one or more additional intermediate spaces.

11. The device according to claim 10, wherein the intermediate space and the one or more additional intermediate spaces are adjacent to one another in the radial direction.

12. The device according to claim 1, in which the tube is provided with one or more securing elements at the top end which are radially adjustable to accommodate sound sources of different widths.

13. The device according to claim 1, and further comprising means for dispensing gas bubbles.

14. The device according to claim 1, and further comprising pump means for pumping water out of the intermediate space.

15. The device according to claim 1, wherein the tube is adapted to anchor in the ground below the body of water on at least one end.

16. A device for the passive reduction of the sound vibrations in a liquid resulting from a sound source arranged below the liquid level of a body of water, the device comprising an elongate tube which can be arranged over the sound source; and pump means able to at least partially pumping out a central interior space delimited by the tube and extending above the liquid level in order to reduce the transmission of noise from the sound source to the inside of the tube.

17. A method for the passive reduction of the sound vibrations in a liquid resulting from a sound source arranged under the liquid level of a body of water, the method comprising:

positioning a tube in the body of water around the sound source, the tube with an uninterrupted and sealed intermediate space in between an outer wall and an inner wall and extending above the liquid level; and anchoring the tube at the bottom end and/or the top end.

18. The method according to claim 17, and further comprising at least partially pumping out an interior space of the tube.

19. The method according to claim 17, and further comprising pumping water out of the intermediate space.

20. The method according to claims 17, wherein the sound source is a pile element.

* * * * *